US006276241B1

(12) United States Patent
Cornog et al.

(10) Patent No.: US 6,276,241 B1
(45) Date of Patent: Aug. 21, 2001

(54) LAMINATED ADJUSTABLE WRENCH

(75) Inventors: Robert A. Cornog, Kenosha; Christopher D. Thompson, Milwaukee, both of WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 0 days.

(21) Appl. No.: 09/507,334

(22) Filed: Feb. 18, 2000

Related U.S. Application Data

(60) Provisional application No. 60/120,511, filed on Feb. 18, 1999.

(51) Int. Cl.[7] ..... B25B 13/16
(52) U.S. Cl. ..... 81/170
(58) Field of Search ..... 81/165, 170; 76/114

(56) References Cited

U.S. PATENT DOCUMENTS

| | | | |
|---|---|---|---|
| 550,025 | 11/1895 | Mossberg . | |
| 552,325 | 12/1895 | Mossberg . | |
| 591,893 | 10/1897 | Smith . | |
| 698,086 | 4/1902 | Wardwell et al. . | |
| 783,814 | 2/1905 | Benson . | |
| 1,016,578 | 2/1912 | Peterson . | |
| 1,302,834 | 5/1919 | Nikonow . | |
| 1,321,236 | 11/1919 | McCraith . | |
| 1,413,495 | 4/1922 | Shook . | |
| 1,419,404 | 6/1922 | Olson . | |
| 1,423,803 | 7/1922 | Illig . | |
| 1,498,656 * | 6/1924 | Herby | 81/165 |
| 1,526,761 | 2/1925 | Robinson . | |
| 1,551,085 | 8/1925 | Carpenter . | |
| 1,723,574 | 8/1929 | Neumerkel . | |
| 1,975,908 * | 10/1934 | Swanson | 81/165 |
| 2,185,002 | 12/1939 | Pack . | |
| 2,618,188 | 11/1952 | Emmett . | |
| 3,183,744 | 5/1965 | Bowman . | |
| 3,603,181 | 9/1971 | Shultz . | |
| 3,657,949 | 4/1972 | Meyers . | |
| 3,695,125 | 10/1972 | Glass et al. . | |
| 3,709,073 | 1/1973 | Kurtz . | |
| 3,745,860 | 7/1973 | Bennett . | |
| 4,061,507 | 12/1977 | Allmendinger . | |
| 4,660,241 | 4/1987 | Chen et al. . | |
| 4,708,034 | 11/1987 | Oetiker . | |
| 4,748,875 | 6/1988 | Lang . | |
| 4,754,668 | 7/1988 | Oetiker . | |
| 5,168,592 | 12/1992 | Jee . | |
| 5,199,332 | 4/1993 | Batten . | |
| 5,660,089 | 8/1997 | Chow . | |
| 5,791,002 | 8/1998 | Gardiner et al. . | |

* cited by examiner

*Primary Examiner*—Joseph J. Hail, III
*Assistant Examiner*—David B. Thomas
(74) *Attorney, Agent, or Firm*—Seyfarth Shaw

(57) ABSTRACT

The wrench comprises a frame having a head and a fixed jaw on the head. A movable jaw is movably carried by the head and movable toward and away from the fixed jaw. The frame, the head and the jaw are composed of stacked plates. Two of the plates of the frame respectively define frame ledges and two of the plates of the movable jaw respectively define jaw ledges. The jaw ledges respectively overlap the frame ledges so that the movable jaw captures the frame, thus preventing the frame from spreading or tending to delaminate under heavy load.

20 Claims, 4 Drawing Sheets

LAMINATED ADJUSTABLE WRENCH

CROSS REFERENCE TO RELATED APPLICATION

This application claims the benefit of U.S. provisional application Ser. No. 60/120,511, filed Feb. 18, 1999.

BACKGROUND OF THE INVENTION

The present invention has to do with wrenches and, in particular, to adjustable wrenches.

An adjustable wrench has a frame, which is typically formed of solid metal and includes a handle and a head defining a fixed jaw. A movable jaw is mounted on the head and includes a rack engageable with a thumb-operated worm gear for translationally moving the movable jaw relative to the fixed jaw. The frame and the movable jaw are typically forged and the construction of the wrench is relatively expensive.

It is known to provide wrenches of other types, such as end wrenches, ratchet wrenches and the like, having a laminated construction, including a plurality of layers of metal stacked together and secured by suitable fasteners, or by bonding or the like. However, such techniques have not heretofore been utilized in adjustable wrenches.

One drawback of laminated wrenches can be a tendency of the layers or plates of the wrench to delaminate or deform and separate under load.

SUMMARY OF THE INVENTION

It is a general object of the invention to provide an improved adjustable wrench which avoids the disadvantages of prior wrenches while affording additional structural and operating advantages.

An important feature of the invention is the provision of an adjustable wrench which is of laminated construction.

In connection with the foregoing feature, another feature of the invention is the provision of a wrench of the type set forth, wherein the handle portion is thinner than the head portion.

Still another feature of the invention is the provision of a laminated adjustable wrench which affords an improved trapping of the movable jaw in the head frame.

In connection with the foregoing features, a still further feature of the invention is the provision of a laminated adjustable wrench which inhibits deformation or separation of the plates of the wrench frame under load.

A still further feature of the invention is the provision of an adjustable wrench of the type set forth, which is of economical construction.

The invention consists of certain novel features and a combination of parts hereinafter fully described, illustrated in the accompanying drawings, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENT

Figure 1:
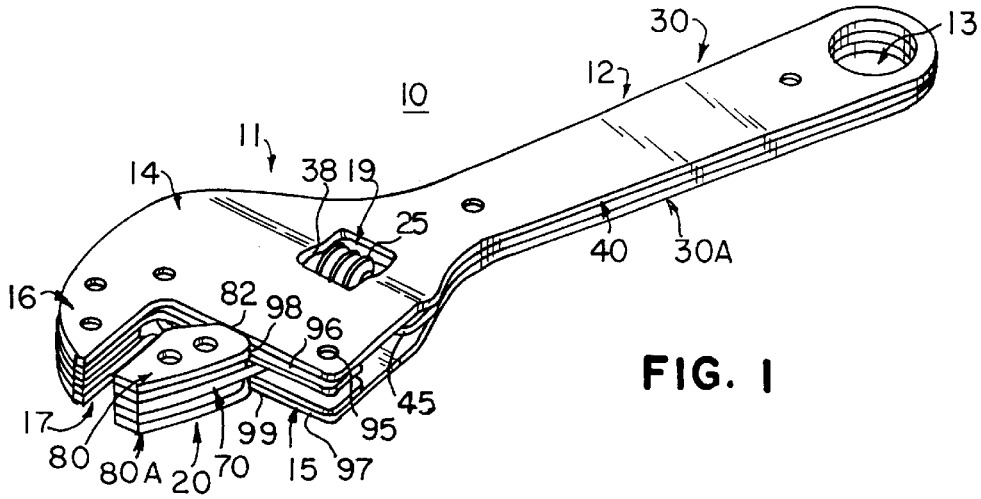
FIG. 1 is a perspective view of an adjustable wrench in accordance with the present invention, with the movable jaw in a nearly fully closed position.
Figure 2:
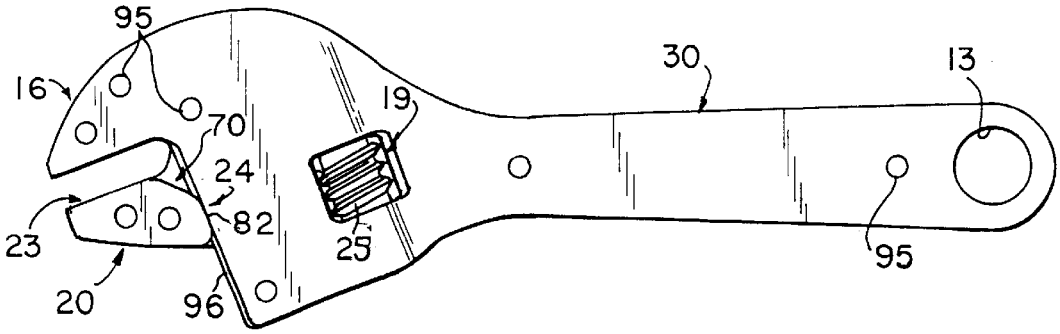
FIG. 2 is a side elevational view of the wrench of FIG. 1.

Referring to FIGS. 1 and 2, there is illustrated an adjustable wrench in accordance with the present invention, generally designated by the numeral 10. The wrench 10 has a frame 11 including a handle 12 with a circular aperture 13 through the distal end thereof, to facilitate hanging the wrench on a hook or the like. The frame 11 also has an enlarged head 14 with a front face 15, from the upper end of which a fixed jaw 16 projects forwardly. The fixed jaw 16 has a gripping face 17 disposed substantially perpendicular to the front face 15 and cooperating therewith to define a generally L-shaped configuration. Formed through the head 14 adjacent to the handle 12 is a generally rectangular opening 19.

The wrench 10 has a movable jaw 20 with a gripping face 23 disposed substantially parallel to and in facing relationship with the gripping face 17 of the fixed jaw 16. The movable jaw 20 also has a rear or sliding face 24 disposed substantially parallel to and in facing relationship with the front face 15 of the head 14. Mounted in the head 14 is a worm gear 25 which projects outwardly through the opening 19 at both sides of the head 14 for manual operation by a user's thumb or finger. The worm gear 25 is rotatable about a shaft 26 for engagement with a rack 74 (see FIG. 3) on the movable jaw 20 for effecting a translational movement of the movable jaw 20 toward and away from the fixed jaw 16, all in a well-known manner.

Figure 3:
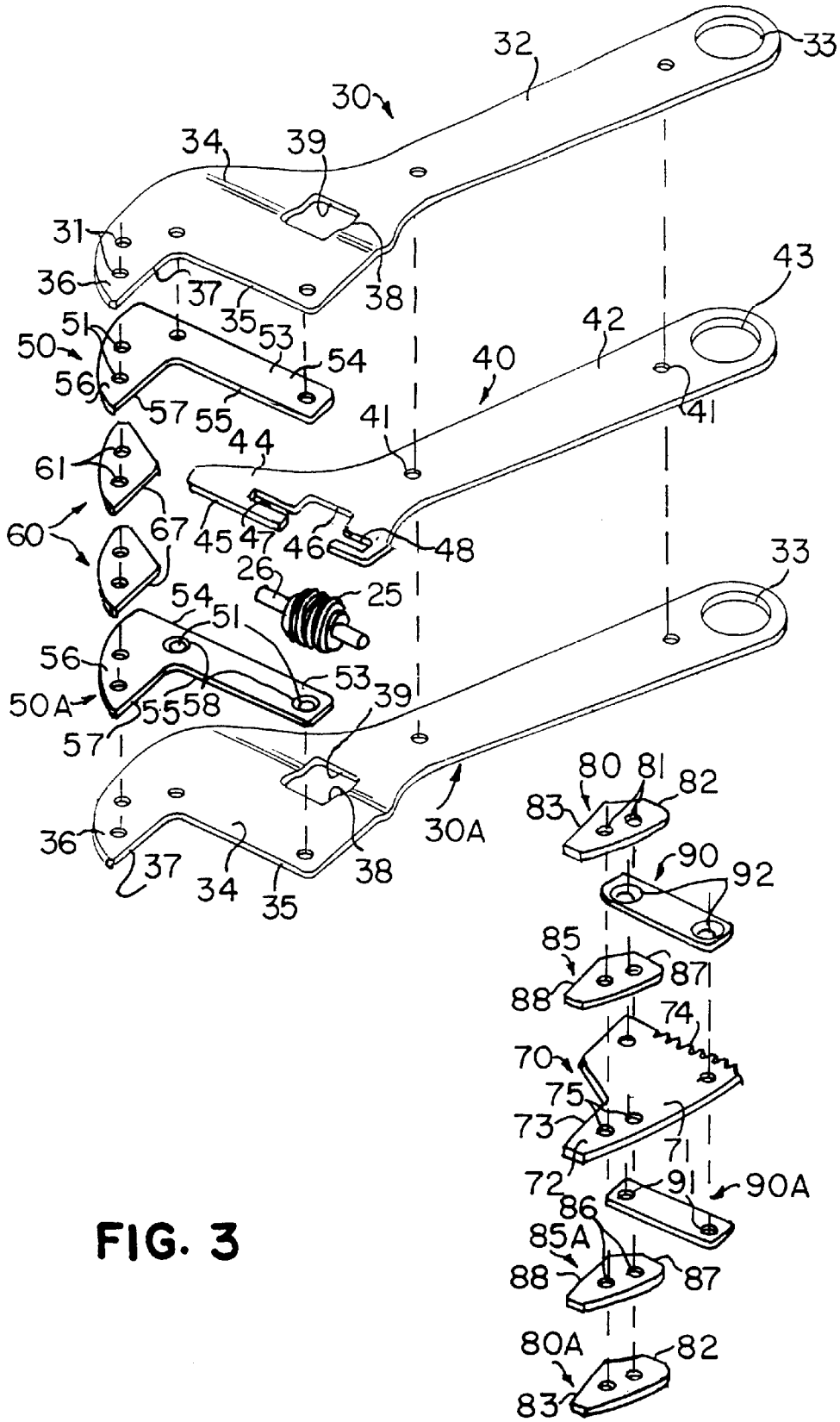
FIG. 3 is an exploded perspective view of the wrench of FIG. 1.
Figure 5:
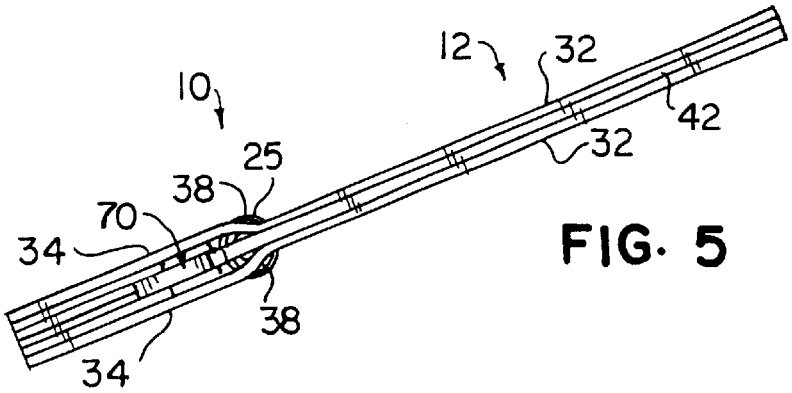
FIG. 5 is a top plan view of the wrench of FIG. 4.
Figure 4:
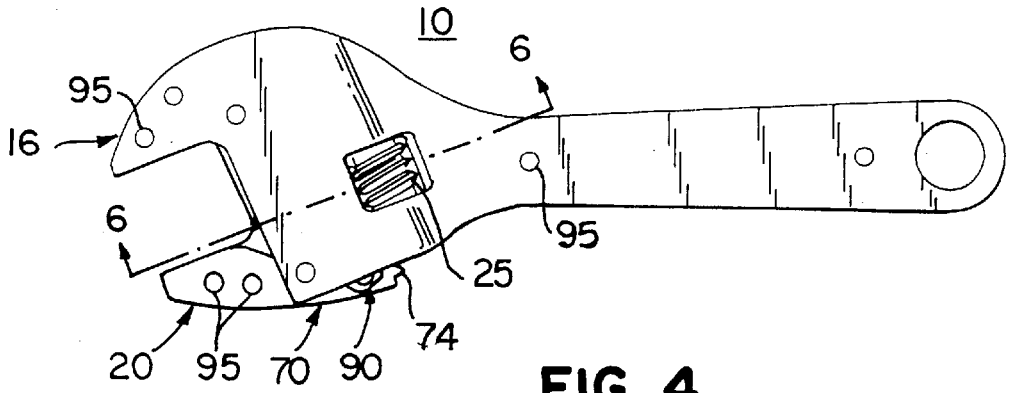
FIG. 4 is a reduced view similar to FIG. 2, with the movable jaws shown in a more widely open position.
Figure 6:
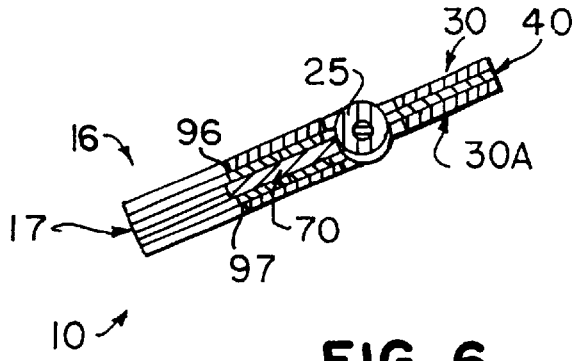
FIG. 6 is a sectional view taken generally along the line 6—6 in FIG. 4.
Figure 7:
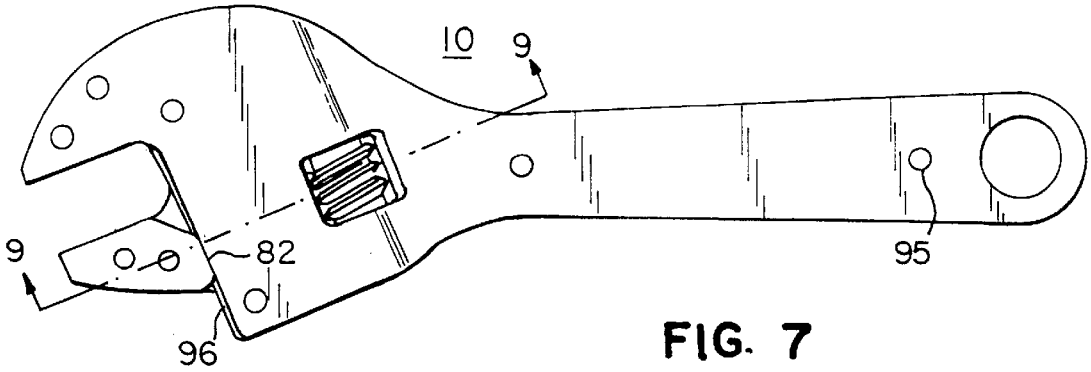
FIG. 7 is a view similar to FIG. 2 with the movable jaw in a position intermediate those of FIGS. 2 and 4.

A fundamental aspect of the invention is that the frame 11 is of laminated construction, being made up of a plurality of stacked metal plates, secured together by suitable fasteners. The frame 11 includes upper and lower frame plates 30 and 30A, which are substantially mirror images of each other, so that like parts of each plate will be designated by the same reference numerals. Referring in particular to FIG. 3, each of the frame plates 30 and 30A has a plurality of small holes 31 therethrough at spaced-apart locations to accommodate suitable fasteners, as will be explained more fully below. Each plate has a handle portion 32 with a circular aperture 33 therethrough at the rear end thereof, and a head portion 34 defining a front edge 35, from which a fixed jaw portion 36 projects forwardly. The fixed jaw portion 36 has a gripping edge 37 which intersects the front edge 35 for cooperation therewith to define a generally L-shaped configuration. The handle portion 32 and the head portion 34 are flat, generally planar portions, respectively lying in substantially parallel planes, which are joined by an inclined shoulder portion 38, which can better be seen in FIG. 5. Thus, it will be appreciated, that when the parts are joined together the wrench handle 12 will be thinner than the head 14. Rectangular apertures 39 are formed through the plates 30 and 30A at the junctions of the handle and head portions 32 and 34.

The frame 11 also includes a middle frame plate 40, which also has fastener holes 41 therethrough and includes a handle portion 42 with an enlarged circular aperture 43 therethrough at the rear end thereof. The frame plate 40 has a head portion 44 which conforms to the shape of the rear portion of the head portions 34 of the frame plates 30 and 30A, and defines a front edge 45. Formed in the front edge 45 is a rectangular notch 46, from which notch arms 47 an 48 project substantially parallel to the front edge 45. The notch 46 is dimensioned to rotatably receive the worm gear 25, with the projecting ends of the gear shaft 26 being respectively received in the notch arms 47 and 48.

The frame 11 also includes a pair of generally L-shaped plates 50 and 50A, which are substantially mirror images of each other, so that like parts of each will be designated by the same reference numerals. Each of the plates 50 and 50A has a plurality of fastener holes 51 therethrough, positioned for alignment with corresponding holes 31 in the frame plates 30 an 30A. Each plate 50 and 50A has an elongated rectangular body 53 with a straight rear edge 54 and a straight front edge 55, from which a fixed jaw portion 56 projects forwardly. The fixed jaw portion 56 has a gripping edge 57 which is disposed substantially perpendicular to the front edge 55 and cooperates therewith to define a generally L-shaped configuration. Each of the fastener holes 51 through the body 53 is countersunk on the inner face thereof, as at 58 (FIG. 3), for a purpose to be more fully explained below.

The frame 11 also has two substantially identical jaw plates 60, each having a generally triangular shape so as to substantially conform to the shapes of the fixed jaw portions 36 and 56 of the plates 30, 30A and 50, 50A. Each of the jaw plates 60 has fastener holes 61 therethrough disposed for alignment with the corresponding holes in the other plates, and a gripping edge 67.

The movable jaw 20 includes a center plate 70 having a body portion 71 from which a jaw portion 72 projects forwardly, the jaw portion 72 having a gripping edge 73. Provided along the rear edge of the body portion 71 is a toothed rack 74 dimensioned for meshing engagement with the worm gear 25. Formed through the body portion 71 and the jaw portion 72 of the center plate 71 are fastener holes 75.

The movable jaw 20 also includes two substantially identical outer jaw plates 80 and 80A, so that like parts are designated by the same reference numerals. Each of the plates 80 and 80A is generally in the shape of an irregular pentagon, three sides of which are, respectively, arranged for substantially congruent overlapping with the jaw portion 72 of the center plate 70. Formed through each plate 80 and 80A are two fastener holes 81 disposed for alignment with the corresponding holes in the center plate 70. Each plate has a rear edge 82 and a gripping edge 83. The movable jaw 20 also includes two substantially identical inner jaw plates 85 and 85A, which are nearly identical in size and shape to the outer plates 80 and 80A, having fastener holes 86, a rear edge 87 and a gripping edge 88. However, the inner jaw plates 85 and 85A are slightly shorter than the outer jaw plates 80 and 80A in front-to-back length.

The movable jaw 20 also includes two substantially identical, generally rectangular retaining plates 90 and 90A, each having a pair of fastener holes 91 therethrough with countersinks 92 on the outer surfaces.

Referring now to FIGS. 3 and 5–9, in assembly the L-shaped plates 50 and 50A are, respectively, secured to the inner faces of the frame plates 30 and 30A with fasteners 95, the inner heads of the fasteners 95 being substantially flush with the inner faces of the L-shaped plates 50 and 50A by reason of the countersinks 58. It is a significant aspect of the invention that the L-shaped plates 50 and 50A are so dimensioned that, when thus assembled to the frame plates 30 and 30A, the front edges 55 of the L-shaped plates project forwardly a slight distance in front of the front edges 35 of the frame plates 30 and 30A to define frame ledges 96 and 97, as can best be seen in FIGS. 1, 2 and 9.

Figure 8:
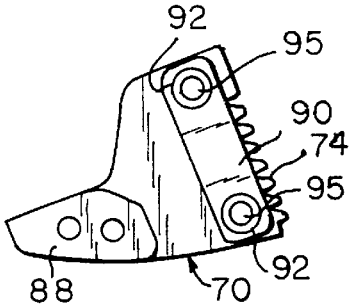
FIG. 8 is a front elevational view of the central plate and two overlying plates of the movable jaw of the wrench of FIG. 7.
Figure 9:
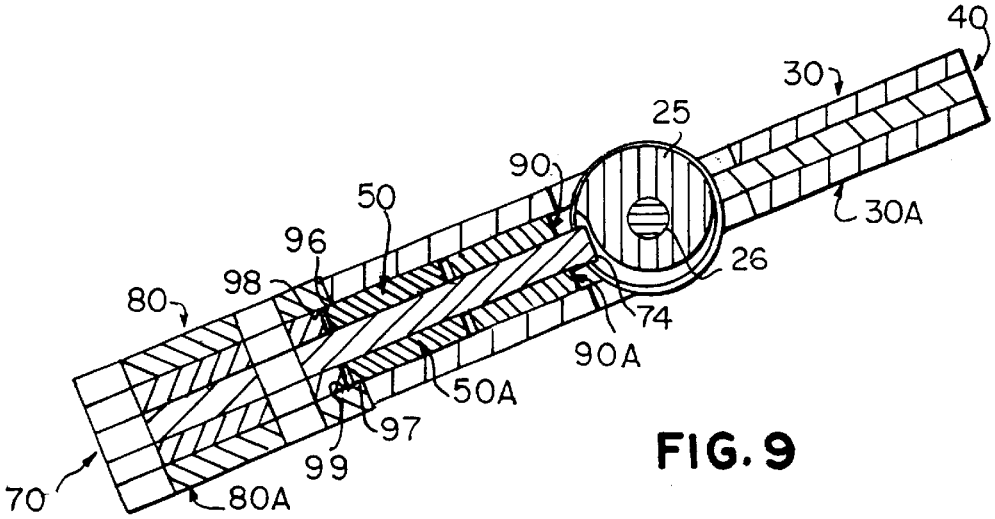
FIG. 9 is an enlarged sectional view taken generally along the line 9—9 in FIG. 7.

The retaining plates 90 and 90A are then, respectively, fixed on the opposite sides of the movable jaw center plate 70 with fasteners 95, as seen in FIGS. 8 and 9, with the fastener heads being substantially flush with the outer surfaces of the retaining plates 90 and 90A by reason of the countersinks 92. The partially assembled movable jaw 20 is then placed on the inner surface of the lower frame plate 30A, with the retaining plates 90 and 90A disposed behind the L-shaped plate 50A (see FIG. 9), whereupon the middle frame plate 40 and the upper frame plate 30 are stacked on the lower frame plate 30A, with the worm gear 25 seated in the middle frame plate notch 46 and its shaft ends in the notch arms 47 and 48, so that the worm gear 25 projects through the plate apertures 39. Then the jaw plates 60 are stacked between the L-shaped plates 50 and 50A and the frame 11 is secured together with the fasteners 95. When thus partially assembled, it will be appreciated that the retaining plates 90 and 90A are, respectively, trapped behind the L-shaped plates 50 and 50A (see FIG. 9) to prevent forward removal of the movable jaw 20, the movable jaw 20 being axially retained by engagement with the worm gear 25.

Finally, the inner and outer movable jaw plates 85, 85A and 80, 80A are stacked on the upper and lower surfaces of the center plate 70 and secured thereto with fasteners 95. It is significant that, because the rear edges 82 of the outer plates 80 and 80A project rearwardly beyond the rear edges 87 of the inner jaw plates 85 and 85A, they respectively define movable jaw ledges 98 and 99 (see FIG. 9), which respectively overlap the frame ledges 96 and 97. By reason of this overlapping engagement, the movable jaw 20 serves to capture the plates of the frame 11, thus preventing the frame 11 from spreading or tending to delaminate under heavy load.

Furthermore, it will be appreciated that the laminated arrangement permits the jaws of the wrench to be thicker than the handle, this difference in thickness being accommodated by the inclined shoulder portions 38 of the frame plates 30 and 30A.

It will be appreciated that the several plates of the frame 11 and the movable jaw 20 are shaped and arranged so as to be stackable in overlapping substantially congruent relationship. Thus, in the frame 11 the apertures 33 and 43 cooperate to form the handle aperture 13, while the apertures 39 cooperate to form the worm gear opening 19. Also, when the parts are secured together in their stacked relationship, the gripping edges 37, 57 and 67 of the frame plates cooperate to define the gripping face 17, while the gripping edges 73, 83 and 88 of the movable jaw 20 cooperate to define the gripping face 23. While the gripping faces 17 and 23 are shown as substantially flat, planar faces, it will be appreciated that they could be grooved or serrated.

Preferably, the fasteners 95 are rivets, but it will be appreciated that other types of fasteners could be utilized, if desired. Alternatively, the plates of the wrench 10 could be bonded together by suitable bonding agents.

From the foregoing, it can be seen that there has been provided an improved adjustable wrench which is of relatively simple and economical construction, affording laminated construction which is relatively strong and resistant to deformation or separation of the laminae.

While a particular embodiment of the present invention has been shown and described, it will be obvious to those skilled in the art that changes and modifications may be made without departing from the invention in its broader aspects. The matter set forth in the foregoing description and accompanying drawings is offered by way of illustration only and not as a limitation.

We claim:

1. A laminated adjustable wrench comprising:

a frame having a head and a fixed jaw on said head, a movable jaw movably carried by the head and movable toward and away from the fixed jaw, the frame and the movable jaw being composed of stacked plates, two of the plates of the frame respectively defining frame ledges substantially parallel to each other, two of the plates of the movable jaw respectively defining jaw ledges substantially parallel to each other and to the frame ledges, the jaw ledges respectively overlapping the frame ledges, whereby the movable jaw captures the frame, thus preventing the frame from spreading or tending to delaminate under heavy load.

2. The wrench of claim 1, wherein the head and the fixed jaw are composed of stacked plates.

3. The wrench of claim 2, wherein the frame has a handle.

4. The wrench of claim 3, wherein the handle and the head are respectively composed of different numbers of plates.

5. The wrench of claim 4, wherein the handle is thinner than the head.

6. The wrench of claim 1, wherein the two plates of the frame extend forwardly beyond adjacent plates of the frame and the two plates of the movable jaw extend rearwardly beyond adjacent plates of the movable jaw.

7. The wrench of claim 1, wherein the stacked plates are secured together by fasteners.

8. A laminated adjustable wrench comprising:

a frame having a head and a fixed jaw on the head, and a movable jaw movably carried by the head and movable toward and away from the fixed jaw, the frame and the movable jaw being composed of stacked plates, the movable jaw including front and rear plates spaced apart in a front-to-rear direction to define a channel therebetween, the frame including a positioning plate disposed in the channel for engagement with the front and rear plates to substantially prevent relative movement of the jaws in front-to-rear directions.

9. The wrench of claim 8, wherein the movable jaw includes a center plate to which the front and rear plates are attached.

10. The wrench of claim 9, wherein the front and rear-plates are first front and rear plates secured to a first side of the center plate and the channel is a first channel, the movable jaw including second front and rear plates secured to a second side of the center plate and defining a second channel therebetween.

11. The wrench of claim 9, wherein the center plate has a rack formed thereon, and further comprising a worm gear engaged with the rack and rotatably carried by the head.

12. A laminated adjustable wrench comprising:

a frame having a head and a fixed jaw on the head, and a movable jaw movably carried by the head and movable toward and away from the fixed jaw, the frame and the movable jaw being composed of stacked plates, two of the plates of the frame respectively defining frame ledges, two of the plates of the movable jaw respectively defining jaw ledges, the jaw ledges respectively overlapping the frame ledges, the movable jaw including front and rear plates spaced apart in a front-to-rear direction to define a channel therebetween, a plate of the frame being disposed in the channel for engagement with the front and rear plates, whereby the movable jaw captures the frame to prevent the frame from spreading or tending to delaminate under heavy load and to substantially prevent relative movement of the jaws in front-to-rear directions.

13. The wrench of claim 12, wherein the movable jaw includes a center plate to which the front and rear plates are attached.

14. The wrench of claim 13, wherein the center plate has a rack formed thereon, and further comprising a worm gear engaged with the rack and rotatably carried by the head.

15. The wrench of claim 12, wherein the head and the fixed jaw are composed of stacked plates.

16. The wrench of claim 15, wherein the frame has a handle.

17. The wrench of claim 16, wherein the handle and the head are respectively composed of different numbers of plates.

18. The wrench of claim 17, wherein the handle is thinner than the head.

19. The wrench of claim 12, wherein the two plates of the frame extend forwardly beyond adjacent plates of the frame and the two plates of the movable jaw extend rearwardly beyond adjacent plates of the movable jaw.

20. The wrench of claim 12, wherein the stacked plates are secured together by fasteners.

* * * * *